US006894219B2

(12) United States Patent
Culbertson

(10) Patent No.: US 6,894,219 B2
(45) Date of Patent: May 17, 2005

(54) SURFACE MOUNT CABLE TELEVISION JACK

(76) Inventor: George A. Culbertson, 419 Howard Rd., Gladwyne, PA (US) 19035

( * ) Notice: Subject to any disclaimer, the term of this patent is extended or adjusted under 35 U.S.C. 154(b) by 0 days.

(21) Appl. No.: 10/622,423

(22) Filed: Jul. 21, 2003

(65) Prior Publication Data

US 2004/0110407 A1 Jun. 10, 2004

Related U.S. Application Data

(60) Provisional application No. 60/399,451, filed on Jul. 31, 2002.

(51) Int. Cl.[7] ..... H01J 5/00

(52) U.S. Cl. ..... 174/50.53; 174/58; 174/41; 439/131

(58) Field of Search ..... 174/58, 50.53, 174/41, 52.1; 361/752; 333/12; 439/131, 910

(56) References Cited

U.S. PATENT DOCUMENTS

| | | | | |
|---|---|---|---|---|
| 3,617,811 | A | | 11/1971 | McVoy |
| 4,403,106 | A | | 9/1983 | Lask et al. |
| 4,922,056 | A | | 5/1990 | Larsson |
| 5,091,707 | A | * | 2/1992 | Wollmerschauser et al. .. 333/12 |
| 5,180,074 | A | * | 1/1993 | Bowman et al. ..... 220/3.8 |

* cited by examiner

*Primary Examiner*—Dhiru R. Patel
(74) *Attorney, Agent, or Firm*—Richard C. Litman

(57) ABSTRACT

The cable television (CATV) jack is a surface mount jack and provides an aesthetically pleasing device for routing communications cables. An extra length of cable may be stored inside the jack, and there are multiple ports on the surfaces of the jack to provide several options for cable connections. The jack has at least one port for entry of an input cable and at least one double female connector extending out from an extension port in the jack for securing an output cable. The jack securely retains the cable and connectors to prevent broken connections. The jack is easily mounted to a surface using screws, or other means, such as adhesive.

11 Claims, 10 Drawing Sheets

SURFACE MOUNT CABLE TELEVISION JACK

CROSS-REFERENCE TO RELATED APPLICATION

This application claims the benefit of U.S. Provisional Patent Application Ser. No. 60/399,451, filed Jul. 31, 2002.

FIELD OF THE INVENTION

The present invention relates generally to connectors for communications cables, and more particularly to a surface mount cable television (CATV) jack.

DESCRIPTION OF RELATED ART

Cable connectors for coaxial and fiber-optic cable are well known. The connectors are used to terminate the end of run of cable, either for direct connection to a television or piece of equipment, or for connection to a second run of cable via an adapter, for purposes such as CATV and other audio, video and data transmissions. The coaxial or fiber-optic cables are typically terminated at places convenient for locating a flush-mounted jack, or convenient for access to the equipment that uses the cables. However, the aesthetics and usefulness of available cable termination methods varies greatly.

Cables are often routed along a walls' surface. In those instances it is not usually possible to terminate a cable at a jack built into a wall, such as a flush-mount jack. With flush-mount jacks the cable is generally routed behind the walls, and the only evidence of the presence of cable is a neat wall plate. Cables are usually routed through a building's walls during building construction or at a major renovation. However, in buildings that already stand, the options include tearing out walls or other parts of the structure to route cables within the walls, or to route the cables along the surface of the walls, often along the baseboards. The former method affords the opportunity to use flush-mounted jacks. By contrast, the latter method, though simple and inexpensive, is not conducive to flush-mount jacks, and can be unsightly.

When cables are routed along a surface, the cables are usually terminated via a connector near the equipment the cable is intended for. The cables are either loose or tacked to the wall. This cable termination method can be unsightly. Further, the uncontrolled and disorganized cables may pose a safety hazard in the event that the equipment is moved so that the cables are exposed. A far better approach is to terminate such cables at a surface-mounted jack to better control the cables. A surface mount jack is a superior method of controlling cables routed along a surface.

U.S. Pat. No. 4,922,056, issued to Arne Larsson in May 1990, describes a surface mounted box for supporting sheathed cable along a support wall. The cable is clamped inside the box.

U.S. Pat. No. 4,403,106, issued to Zygmunt Lask et al. in September 1983, discloses a terminal enclosure for cable stubs, with variable entry positions.

U.S. Pat. No. 3,617,811, issued to David McVoy in November 1971, discloses a cable television tapoff unit. It includes an interchangeable circuit board.

None of the above patents describes a surface mounted cable jack that is aesthetically pleasing, houses extra cable, securely locks the cable in place, and permits access out of any of the multiple ports on the surface of the jack. Thus, there is a need for a surface mounted cable jack with some or all of those attributes.

None of the above inventions and patents, taken either singly or in combination, is seen to describe the instant invention as claimed.

SUMMARY OF THE INVENTION

The cable television (CATV) jack is a surface mount jack and provides an aesthetically pleasing device for routing communications cables. An extra length of cable may be stored inside the jack, and there are multiple ports on the surfaces of the jack to provide several options for cable connections. The jack has at least one port for entry of an input cable and at least one double female connector extending out from an extension port in the jack for securing an output cable. The jack securely retains the cable and connectors to prevent broken connections. The jack is easily mounted to a surface using screws, or other means, such as adhesive.

It is therefore a principal object of the invention to disclose a surface mount cable television (CATV) jack that is surface mounted to accommodate cables, including coaxial, fiber-optic, and other sheathed cable, that are routed along a surface, such as a wall.

It is another object to provide a surface mount CATV jack having a variety of terminal locations on the jack, via a plurality of panels forming the housing of the jack.

It is a further object of the invention provide a surface mounted cable jack that securely retains the cable within the jack and prevents broken connections.

It is another object of the invention to provide a weather-tight jack enclosure that protects the internal connections from the elements.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a surface mount cable jack comprising a base, a cover, a plurality of access ports, and a retention means.

Figure 1:
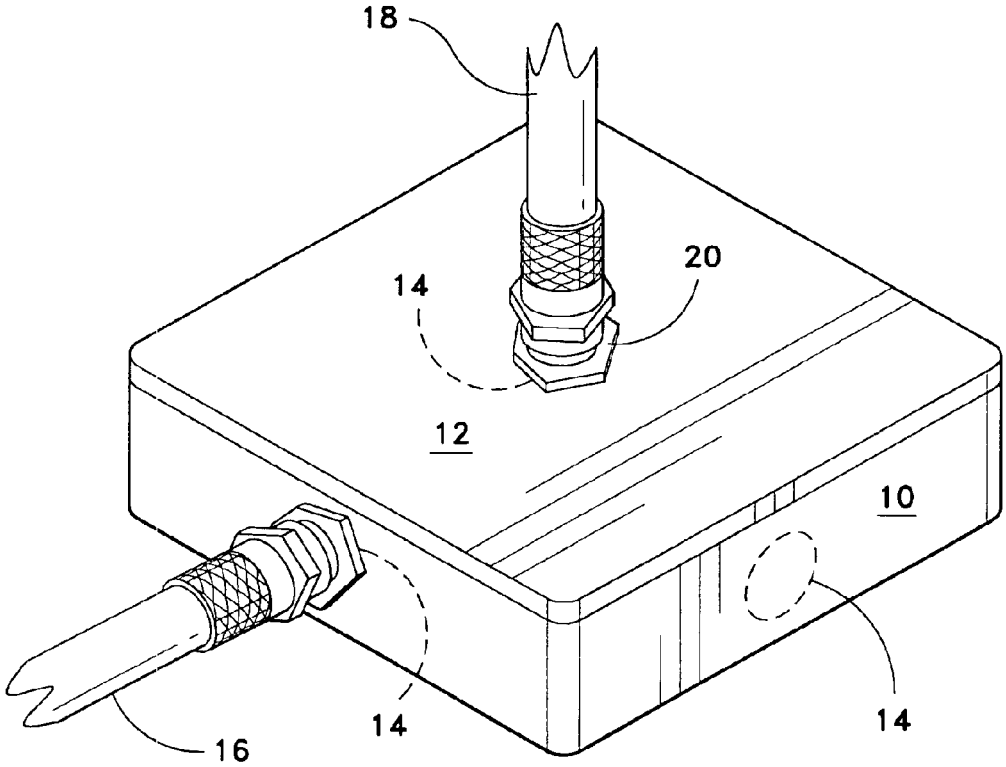
FIG. 1 is an environmental, perspective view of a surface mount cable jack according to the present invention.

Referring to the Figures, an environmental, perspective view of a surface mount cable jack according to the present invention in FIG. 1. The base 10 is hollow and, together with the cover 12, forms the jack housing. The base 10 provides an open-topped cable enclosure formed by a bottom wall and a sidewall extending around the bottom wall and including retention means for securing cables and their various connecting components. The sidewall is at least high enough to enclose a cable and a plurality of connectors. The retention means may be a plurality of clamps or a receptacle into which cables or connectors may be snapped, clamped, screwed or otherwise fastened to secure cables and cable splitters or connectors. The retention means may be a plurality of flexible pins protruding from the bottom wall of the base 10 perpendicular to the bottom wall and evenly spaced through the base 10, about which cable may be routed and securely retained. The flexible pins are flared or hooked at their terminal ends to provide better retention for cables, connectors or splitters enclosed within the jack. The plurality of access ports, or knockout plugs, 14 provide numerous options and combinations for an input cable 16 and an output cable 18. The cover 12 may attached to the base 10 by a friction fit such as walls inter-fitting with the walls of base 10. In one embodiment (see FIGS. 1 and 2), when the output cable 18 exits the jack through the cover 12, the cover 12 is secured to the base 10 via an output nut 20. The cover 12 may, alternatively, be secured to base 10 by a hinge or a snap fitting as desired, or a combination of these securing means. The orientation of the plurality of access ports 14 permits the user to access the connector nuts with a wrench.

Figure 2:
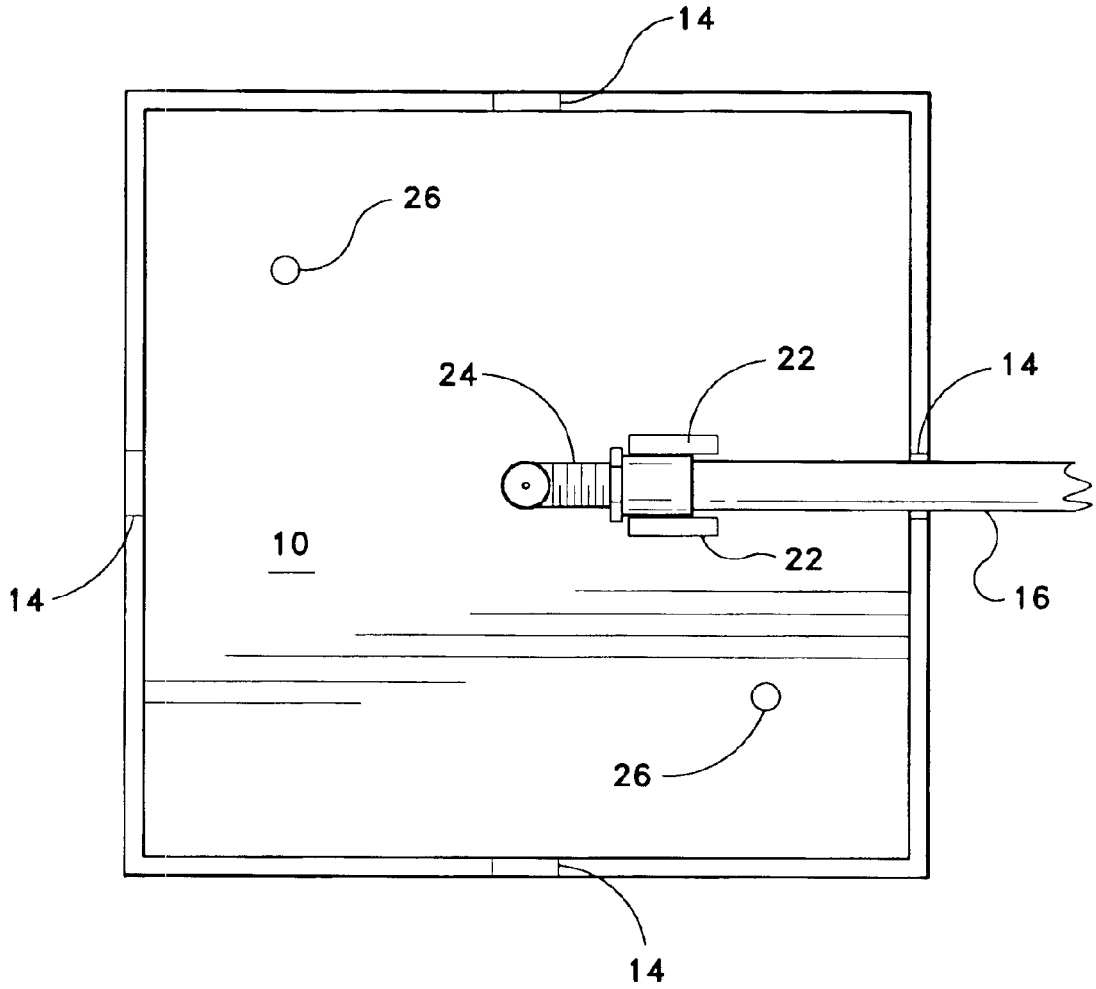
FIG. 2 is a plan view of a base for a surface mount cable jack according to one embodiment of the invention.

Referring to FIG. 2, there is shown a plan view of a base for a surface mount cable television jack according to one embodiment of the invention. The use of an angled connector, a female-to-female right angle connector 24 in this depiction, is shown. However, the connector could be a male to female or a male-to-male connector as well. The input cable 16 enters the base 10 through an access port 14. The plurality of access ports 14 may be covered by knockout plugs or by removable and replaceable panels (not shown) that permit reconfiguration of the jack without leaving the previously used ports open. A connector clamp 22 is attached inside the base 10 to secure the female-to-female right angle connector 24 adjacent to an access port 14 in the base 10 or the cover 12 so that the output terminal of the connector is properly aligned to extend through the access port selected for output. The connector clamp 22 may hold the female-to-female right angle connector 24 at the female-to-female right angle connector's 24 flats. The female-to-female right angle connector 24 may further be secured in place by cover 12 and connector nuts 20. A plurality of screw mounting holes 26 are located in the base 10 to permit the jack to be screwed to a surface. In one embodiment, there may be multiple access ports on each flat side of the base 10.

Figure 3:
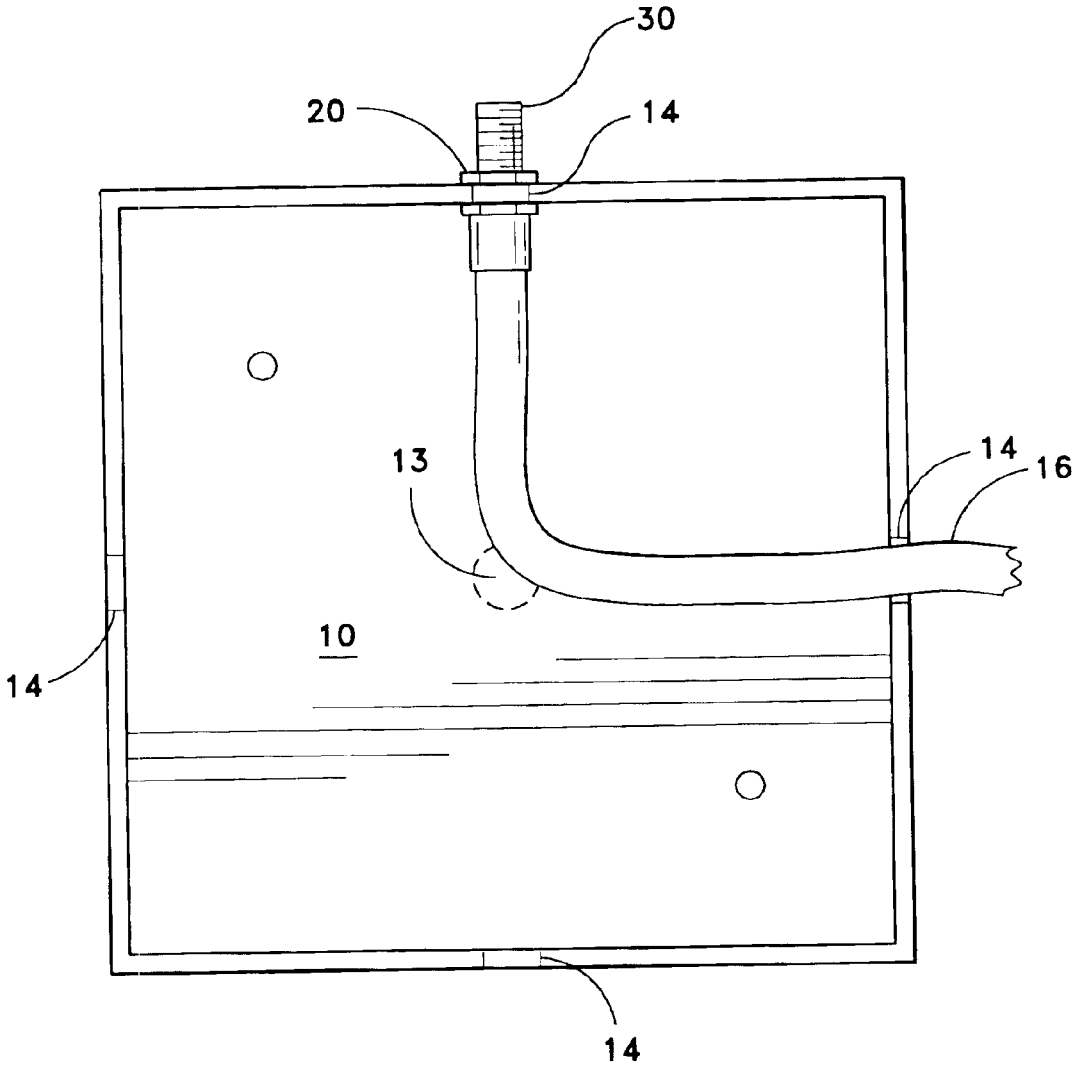
FIG. 3 is a plan view of a base of a surface mount cable jack according to another embodiment of the invention.

Referring to FIG. 3, there is shown plan view of a base of a surface mount cable jack according to another embodiment of the invention. FIG. 3 shows the use of a straight connector in the surface mount CATV jack according to the invention. The input cable 16 enters the base 10 through an access port 14. The input cable 16 is attached to a double female connector 30. The double female connector 30 is placed through the desired access port 14 and is attached to the base 10 with a connector nut 20. An output end of the double female connector 30 then protrudes from the base 10. The base 10 has a rear access port 13 (shown as a knockout plug) which permits a cable to enter or exit the base 10 at the side of the base that faces the wall when the jack is mounted. This allows the surface mount jack of the present invention to be used as a replacement for a flush mount jack.

Figure 4:
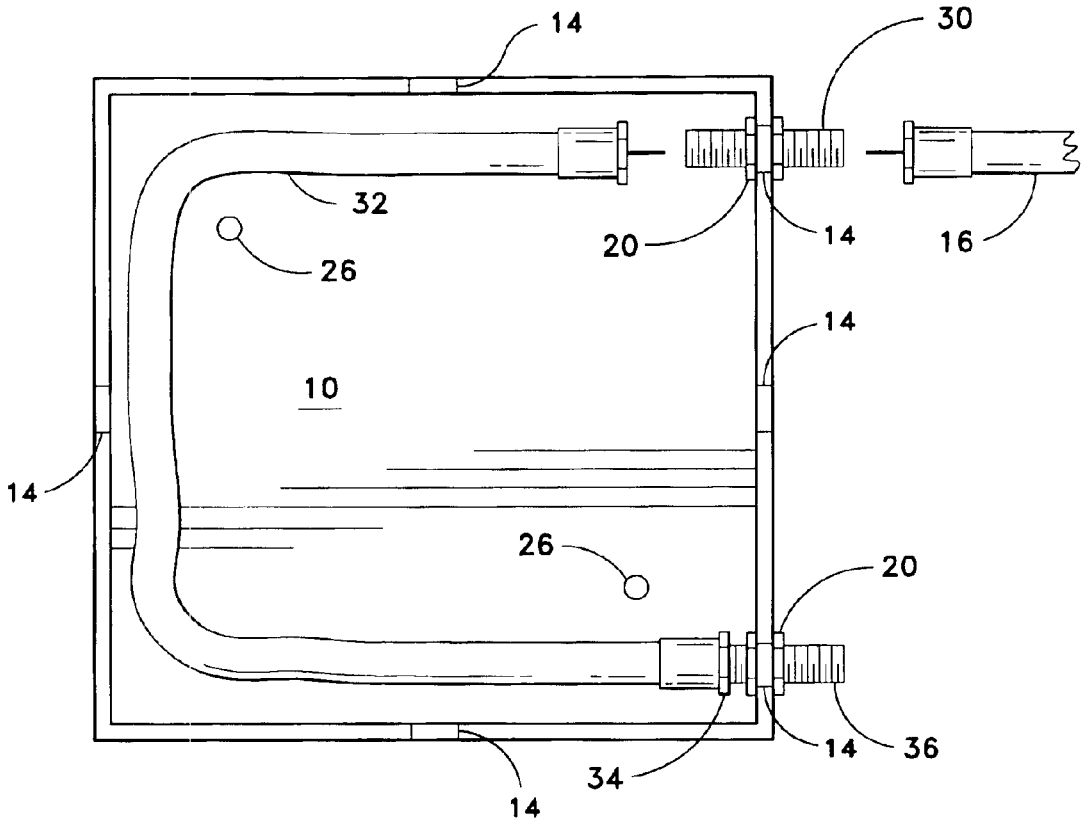
FIG. 4 is a plan view of a base of a surface mount cable jack according to still another embodiment of the invention.

Referring to FIG. 4, there is shown a plan view of a base of a surface mount cable jack according to another embodiment of the invention. The input cable 16 attaches to double female connector 30, such as an F-81, at a desired input location on the base 10. The double female connector 30 is secured through an access port 14 in the base 10 between a pair of connector nuts 20. A length of extra cable 32 is attached to the same double female connector 30 as the input cable 16. The extra cable permits the user to replace damaged connectors or cable without a visible, external splice. The extra length of cable may be replaced when it becomes too short to use effectively. The extra length of cable 32 terminates in an output connector 34 that will attach to an output double female connector 36 whereby the output double female connector 36 will protrude through the access port 14 in the base 10 and will be secured to the base 10 via an output connector nut 28.

Figure 5:
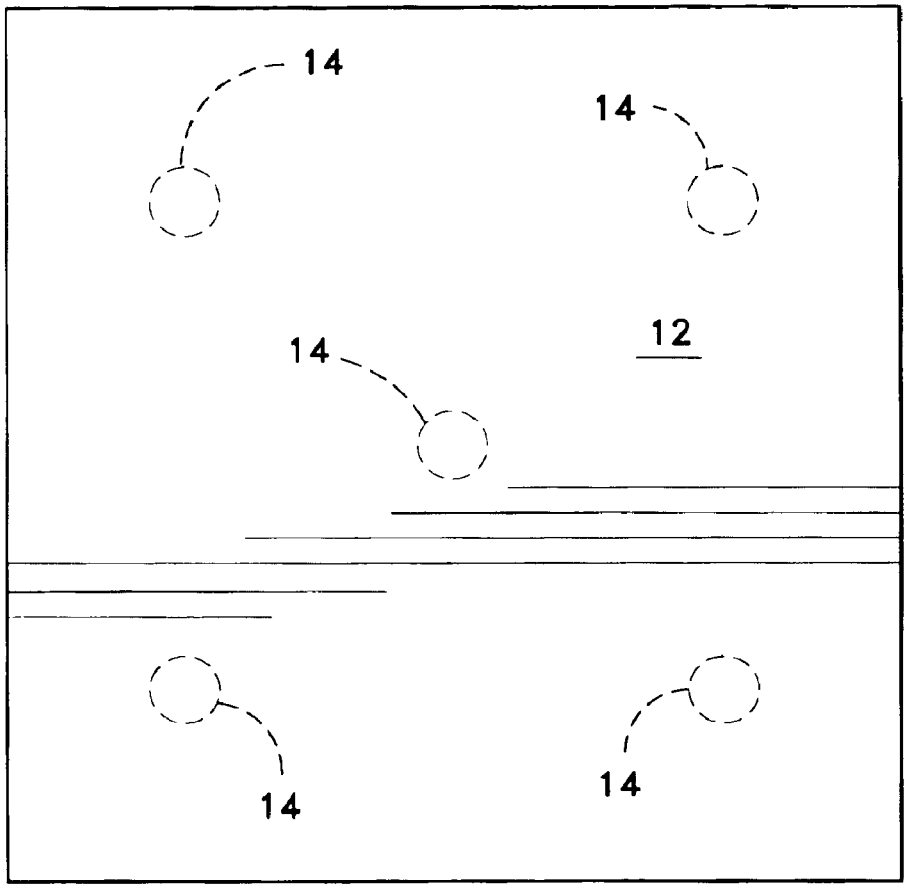
FIG. 5 is a plan view of a cover of a surface mount cable jack according to the invention.
Figure 6:
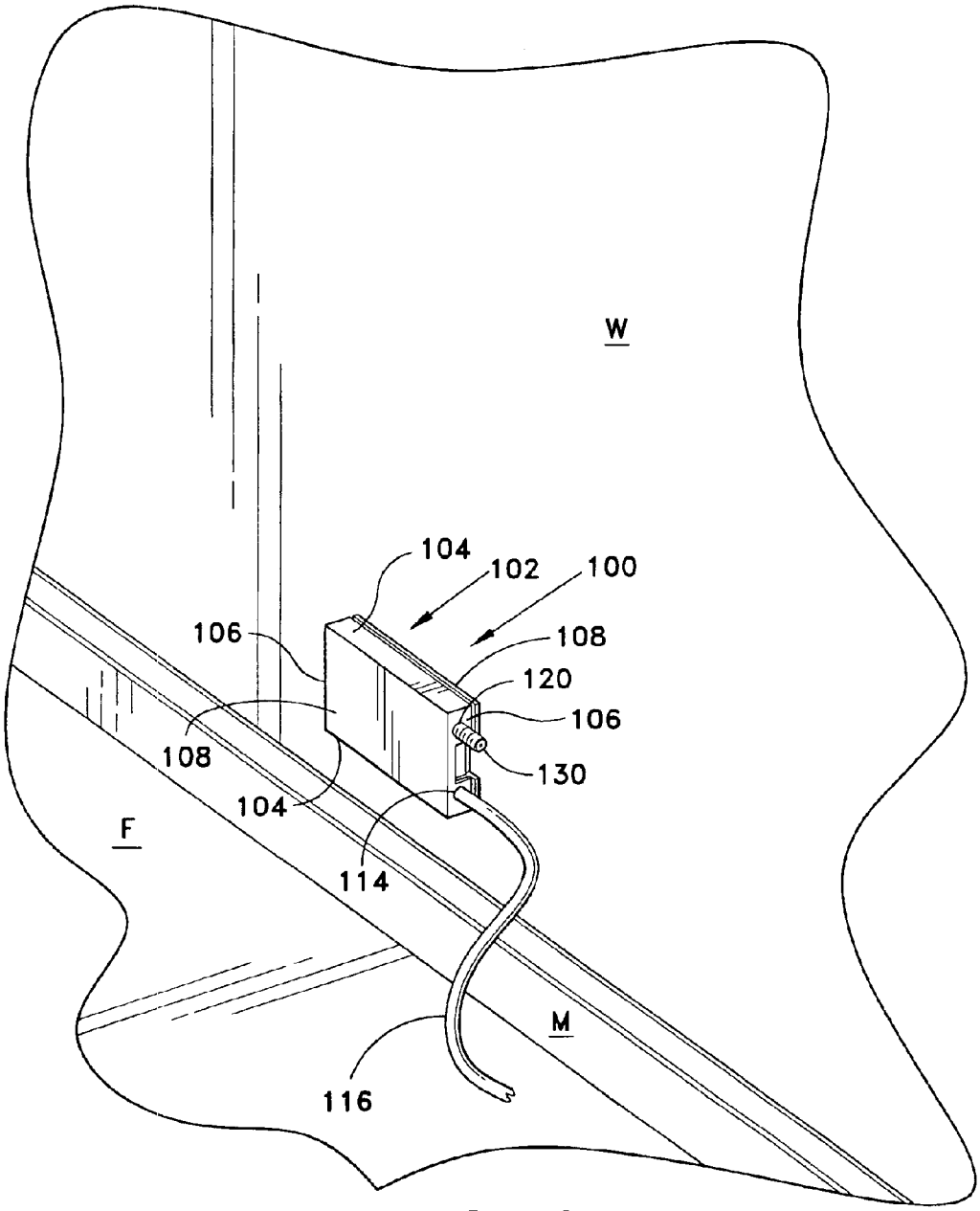
FIG. 6 is an environmental perspective view of another embodiment of the surface mount cable jack according to the present invention.

Referring to FIG. 5, there is shown a plan view of a cover of a surface mount cable jack according to the invention. The cover 12 conforms to the size and shape of the base 10 whereby the cover 12 mates with the base 10 to house the connectors or splitters employed in the user's particular application. The cover 12 comprises a plurality of access ports 14, so that the user may route an output connector through the cover 12 instead of a side of the base 10. The number and configuration of the plurality of access ports 14 are variable, depending upon the needs of the user. The plurality of access ports 14 may be knockout plugs, or panels or other means that may be replaced after removal. Where a cable splitter is used (not shown), there may be multiple output connectors exiting the jack simultaneously, through the sides of the base 10 or through the cover 12. The cover 12 is labeled as to the type of service provided at a jack. The label may be molded into the cover 12, it may be printed on the cover 12, or adhesive labels may be used.

The cover 12 may be attached to the base 10 along an edge via a hinge means. The hinge means would allow access to the inside of the jack without the risk of misplacing the cover 12.

The assembled jack may be made weather resistant or weather proof, allowing the jack to be used in applications outdoors. The jack housing is sealed via a gasket (not shown) between the cover 12 and the base 10, and each of the plurality of access ports 14 includes a grommet (not shown) to seal out the elements.

Referring to FIGS. 6–11, there is shown another embodiment of the surface mount CATV jack of the present invention designated as element number 100. Jack 100 has a generally rectangular housing 102 having opposed sidewalls 104, opposed endwalls 106, and opposed inner and outer walls generally designated 108. Housing 102 is formed by a base 110 for mounting on a surface such as wall W, and a cover 112 when cover 112 is closed over base 110. Coaxial or fiber-optic cable 116 has a female cable connector collar 118 connected with female-to-female double connector 130.

Cable 116 enters the closed jack 100 through cable entry port 114 as the jack is mounted on wall W, typically at a point near floor F and above any molding M. Connector 130 extends from the housing through connector extension port 121. Cover 112 has an outer wall 122 parallel with base inner wall 136 and has side walls 124, cover closure end wall 126, and opposing cover cable access end wall 128, each cover wall preferably being of equal depth so as to fit snugly with peripheral rim 158 of base 110 and of such depth as to accommodate the entry of cable 116 through entry port 114 and the exit of cable double connector 130 through extension port 120 with sufficient clearance for the turning of connector securing nuts 132.

Figure 7:
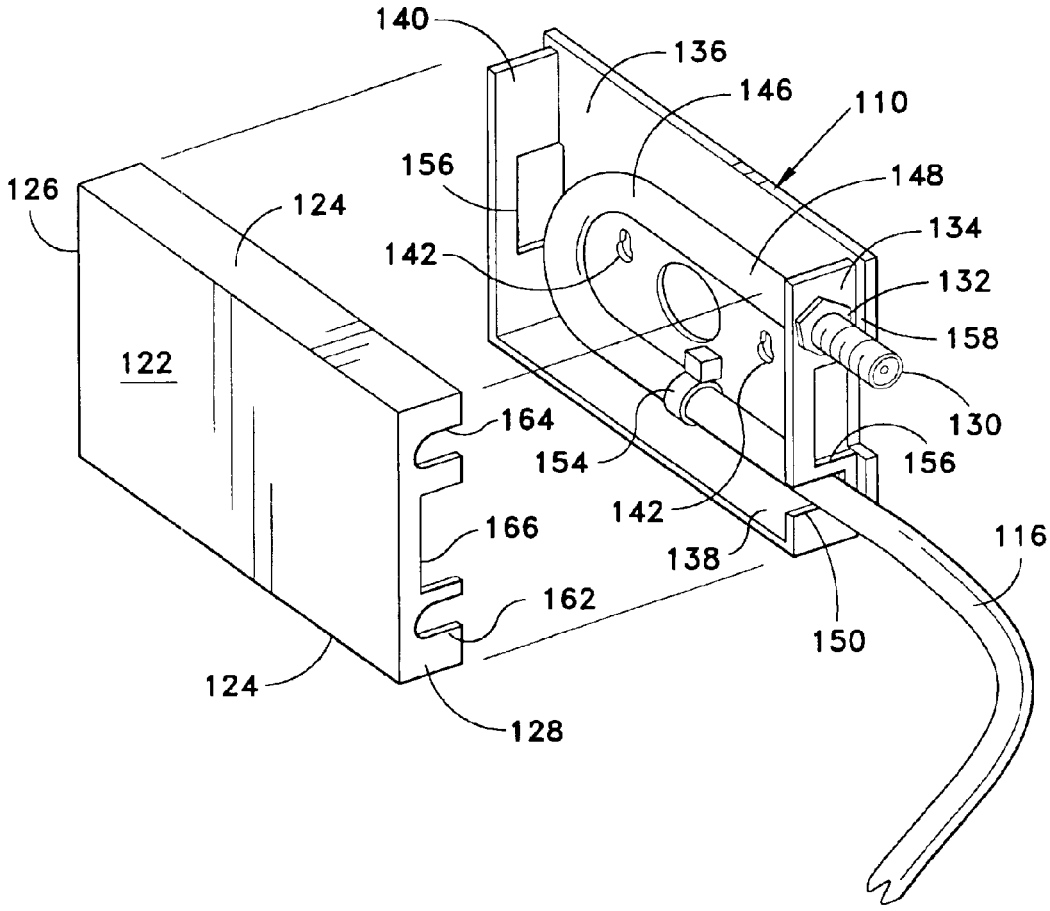
FIG. 7 is an exploded view of the invention of FIG. 6 as taken from an upper right angle.
Figure 8:
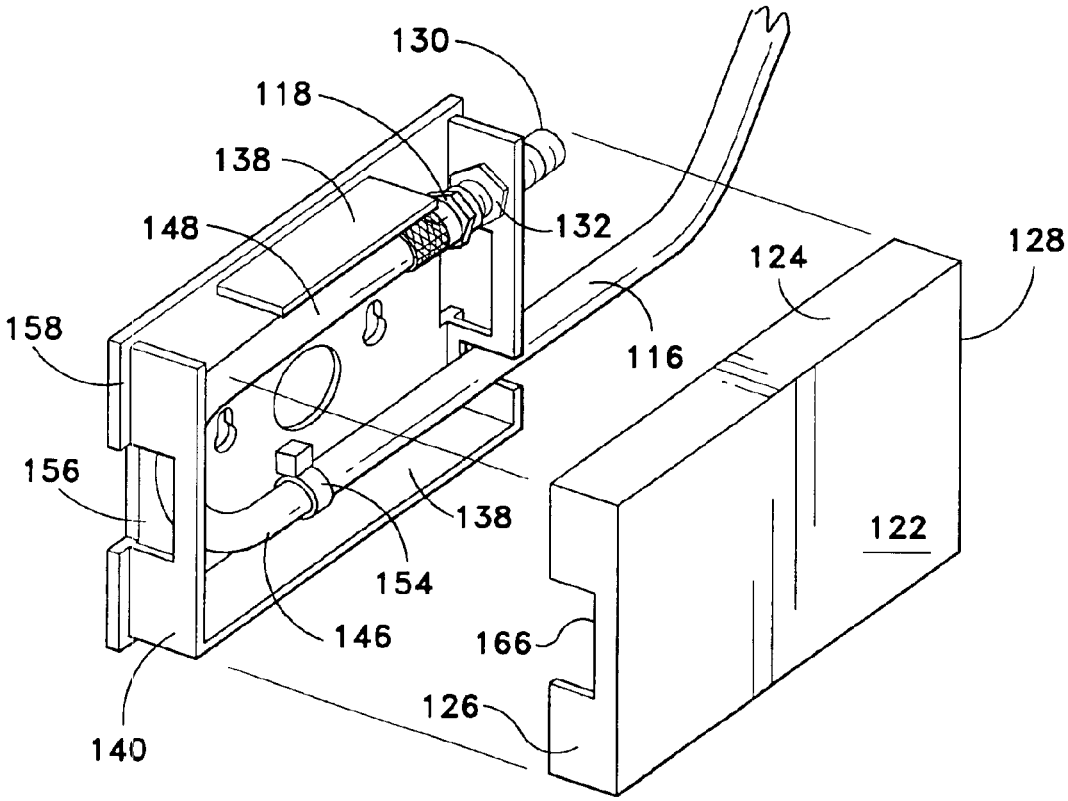
FIG. 8 is an exploded view of the invention of FIG. 6 as taken from an upper left angle.

As seen in FIGS. 7 and 8, base 110 has a base cable mount end wall 134, side walls 136 and base closure end wall 140 mounted around and perpendicular to base inner wall 136 and spaced inward from the periphery therefrom by the width of base peripheral rim 158. The walls of base 110 are preferably about equal in height to the depth of the walls of cover 112 and positioned such that cover 112 will slidingly fit over the walls of base 110 and fit flush against peripheral rim 158 upon closure of cover 112 over base 110 (note the base upper side wall may be deleted as in FIG. 7). Base inner wall 136 has a pair of screw mountings 142 therethrough for mounting on wall W (the screws are not shown).

Coaxial or fiber-optic cable 116 has a bend portion 146 near base closure end wall 140 and a straight end portion 148 leading to connector collar 118 and female-to-female double connector 130. Cable entry port 114 is located near the lower side wall of jack 100 and is formed by aligned base cable inlet groove 150 in base wall 134 and cover cable inlet groove 162 in cover wall 128 when cover 112 is closed over base 110 to form the entry for cable 116 to jack 100. Connector exit port 120 is located near the upper side wall of jack 100 and is formed in base wall 134, cover outlet groove 164 in cover end wall 128 sliding over double connector 130 when cover 112 is closed over base 110.

One or more cable tiedowns 154 maintain cable 116 secure and properly located relative to base inner wall 136 within jack 100. Base end wall access openings 156 are centrally aligned within opposing base end walls and corresponding cover end wall access openings 166 are located within opposing cover end walls so as to align with base end wall access openings 156 when cover 112 is closed over base 110. Base closure end wall 140 contains knockout connector entry port 160 which may be removed for receiving a coaxial connector as desired in a modified version of the embodiment of jack 100. It is noted that connector entry ports 120 and 160 have a hexagonal recess for receiving and holding a connector nut 132 in place. Base closure end wall 140 also contains a knockout cable inlet groove 161 which may be removed for receiving cable 116 as desired in a modified version of the embodiment of jack 100.

Figure 9:
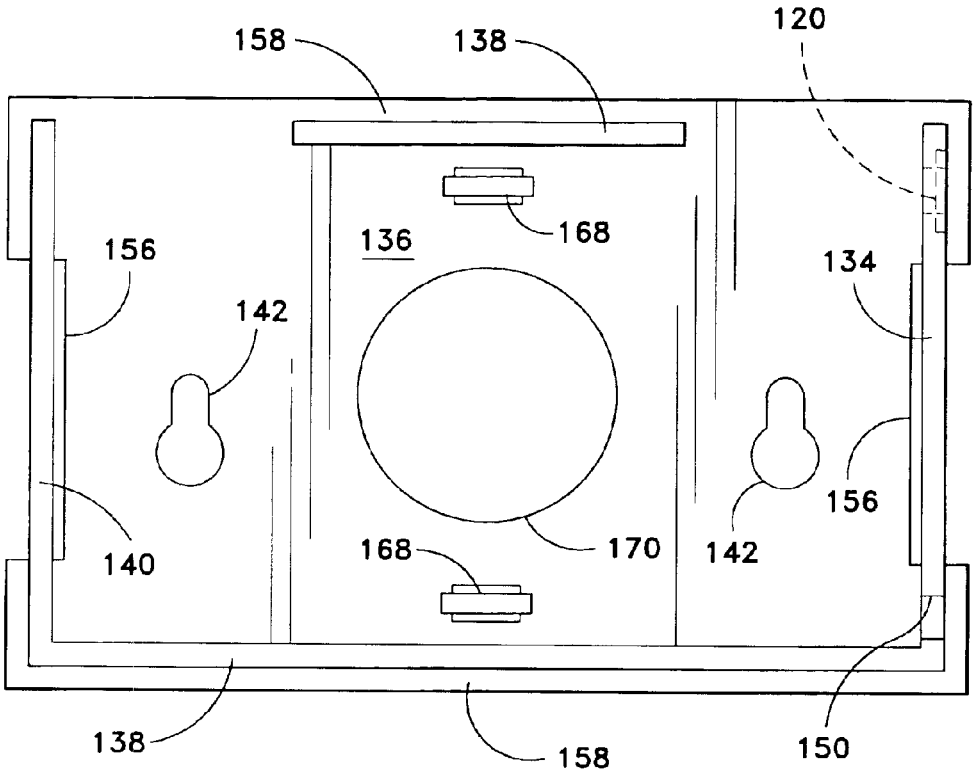
FIG. 9 is a plan view of the invention of FIG. 6 with the cap removed.
Figure 10:
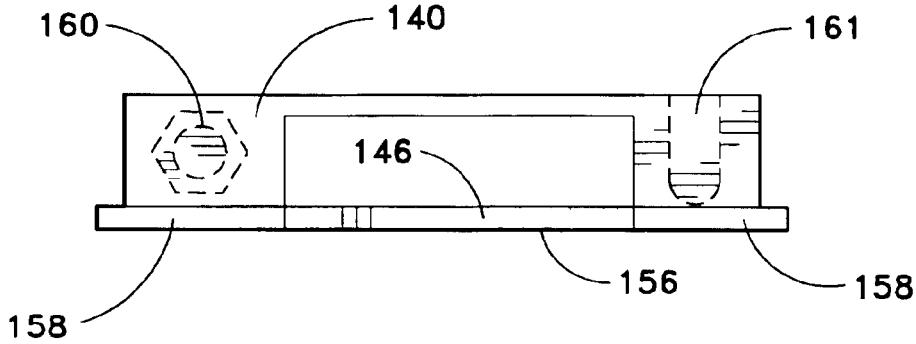
FIG. 10 is a right side end view of the invention of FIG. 6 with the cap removed.
Figure 11:
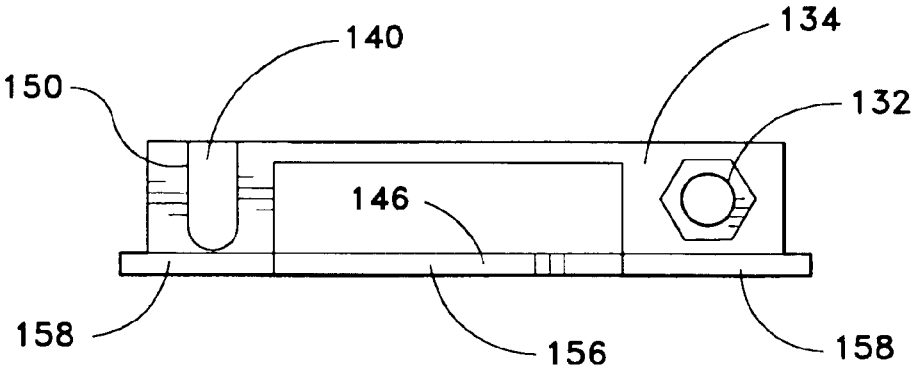
FIG. 11 is a left side end view of the invention of FIG. 6 with the cap removed.

As seen in FIG. 9, tiedown receivers 168 are located within base inner wall 136 for mounting tiedowns 154 as required for secure location of cable 116 within jack 100. A back entry bore 170 is generally centrally located in base inner wall 136 of such size as to allow easy installation of the surface mount CATV jack of the present invention over an existing flush mount jack in wall W. This allows the surface mount jack of the present invention to be used as a replacement for a flush mount jack. The cover outer wall may have a plurality of knockout plugs similar to those shown as knock out ports 14 of FIG. 5.

The CATV jack housing cover and base are preferably made of injection molded plastic. The double connectors, cable, cable collars and connector securing nuts are commercially available and, taken alone, are not part of the present invention.

It is to be understood that the present invention is not limited to the sole embodiments described above, but encompasses any and all embodiments within the scope of the following claims.

I claim:

1. A surface mount cable television jack for coaxial, fiber-optic, or other sheathed cable comprising:

a rectangular housing having opposed inner wall and outer walls, opposed sidewalls, and opposed end walls and comprising:

a generally rectangular base having an inner wall and peripheral opposed sidewalls, a closure end wall, and a cable mount end wall;

a generally rectangular cover having an outer wall and peripheral opposed side walls, a closure end wall, and a cable access end wall and conforming with said rectangular base such that said peripheral cover walls slidingly engage said peripheral base walls and abut said inner wall of said rectangular base upon closure of said cover over said base;

said housing having a cable entry port and a cable connector extension port, each said port defined by any of said end walls and said side walls of said housing; and at least one female cable connector extending through said cable connector extension port.

2. The surface mount cable television jack according to claim 1, wherein said at least one female cable connector is a linear female-to-female cable connector having securing nuts removably mounted thereon.

3. The surface mount cable television jack according to claim 2, said base inner wall having a peripheral rim extending beyond said peripheral walls, said peripheral walls of said cover abutting said peripheral rim when closed over said base to form said housing.

4. The surface mount cable television jack according to claim 2, wherein said peripheral walls of said base are of such dimensions as to accommodate the entry of the input cable through said cable entry port and to accommodate the exit of said female connector and the turning of said securing nuts within and without said housing.

5. The surface mount cable television jack according to claim 2, wherein said inner wall of said base defines at least one screw mounting for receiving a screw mounting said base to a wall or other support.

6. The surface mount cable television jack according to claim 2, wherein said cable entry port and said cable connector extension port are defined by a common housing end wall.

7. The surface mount cable television jack according to claim 6, wherein the input cable extends through said cable input port, forms a bend portion proximate the housing end wall opposite said cable entry port and form a generally straight portion and ending in a cable connector collar, said collar being connected to said female-to-female connector at an end opposite that extending from said cable connector extension port.

8. The surface mount cable television jack according to claim 7, wherein said connecting nuts secure said extension portion of said female-to-female connector to said cable mount end wall of said base forming said housing common wall.

9. The surface mount cable television jack according to claim 7, further comprising at least one cable tiedown attached to said base inner wall within said housing for positioning the input cable.

10. The surface mount cable television jack of claim 1, wherein said housing inner wall defines a centrally disposed aperture of such dimensions as to cover and receive a flush-mounted jack connector in said wall, thus converting said flush-mount jack to a surface mounted jack.

11. The surface mount cable television jack of claim 1, wherein said base closure end wall defines a knockout cable inlet groove plug and a knockout connector extension port.

* * * * *